United States Patent [19]

Kloc

[11] 4,137,815

[45] Feb. 6, 1979

[54] MULTI-TONE MUSICAL DRUM

[76] Inventor: Hyman Kloc, 2007 Stearns Ave., Kalamazoo, Mich. 49008

[21] Appl. No.: 777,109

[22] Filed: Mar. 14, 1977

[51] Int. Cl.[2] ..... G10D 13/08

[52] U.S. Cl. ..... 84/408

[58] Field of Search ..... 84/402, 403, 408, 409, 84/411

[56] References Cited

U.S. PATENT DOCUMENTS

| | | | |
|---|---|---|---|
| 2,502,722 | 4/1950 | Handler | 84/403 |
| 2,634,649 | 4/1953 | Nemeth | 84/408 |
| 3,705,527 | 12/1972 | Burnham | 84/403 |

OTHER PUBLICATIONS

"The Music Trades", Jan. 1974, p. 80.
"The Music Trades", Jan. 1976, p. 65.
David Wexler & Co., Catalog #66, 1965, p. 174.

*Primary Examiner*—Lawrence R. Franklin
*Attorney, Agent, or Firm*—Austin A. Webb

[57] ABSTRACT

A box consisting of bottom, side and end walls forms a resonating chamber. An integral sounding panel has thickened ribs on the underside of its ends secured to the tops of the end walls with continuous side strips overlying the tops of the side walls of the chamber in spaced relation thereto. Between the side strips, the panel has three or more spaced longitudinal slots formed therethrough and extending between the ribs on the bottom of the panel. Transverse slots are formed between adjacent longitudinal slots at different distances from the ends of the panel forming vibratory fingers of different lengths. The undersides of the free ends of the fingers have thickened portions which are equal in thickness to the end ribs on the panel, and which extend from the free ends of all of the fingers to an equally spaced distance from the end ribs. Continuous top rails are secured along the ends of the top of the panel in opposed relation to the end walls of the resonating chamber and transversely across the ends of the side strips and the vibratory fingers.

5 Claims, 3 Drawing Figures

MULTI-TONE MUSICAL DRUM

The drawings, of which there is one sheet, illustrate a preferred form of the drum.

Figure 1:
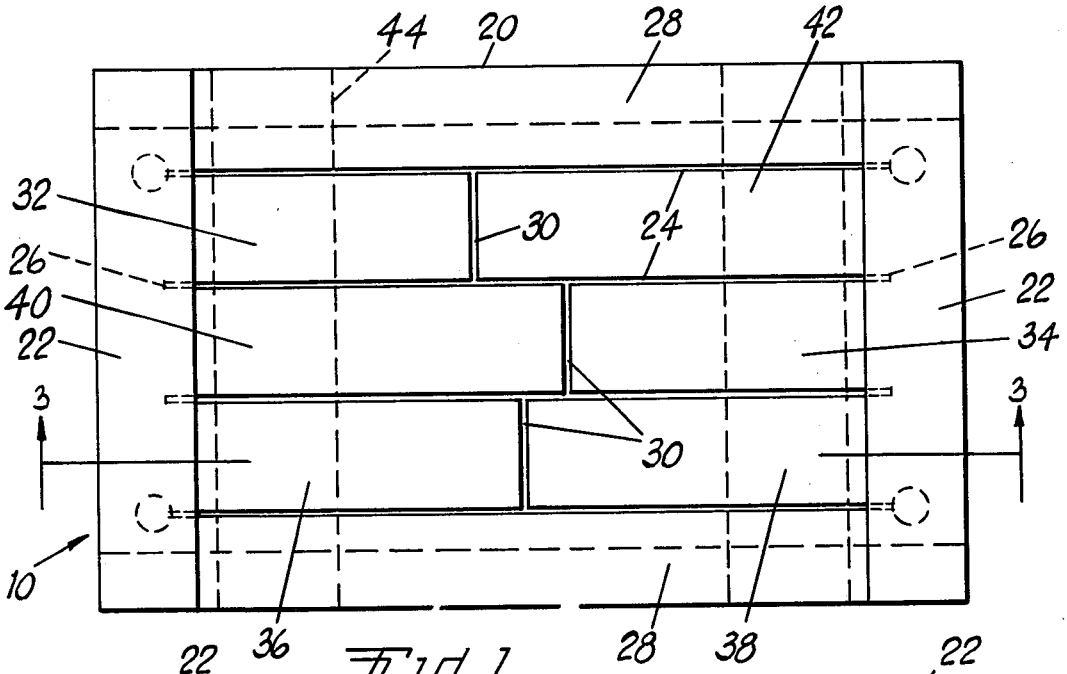
FIG. 1 is a top plan view of the drum.

A box like resonating chamber indicated generally by the numeral 10 is made up of side walls 12, end walls 14 and 16, and a bottom wall 18. A striking panel 20 consisting of an integral piece of hardwood has its ends secured to the tops of the end walls 14 and 16 and the ends of the side walls 12. Wooden rails 22 are secured along the top of the ends of the striking panel. The underside of the striking panel is shaped or conformed as will be described presently. All of the joints between the several walls and panels are desirably made with adhesive (not illustrated).

Figure 2:
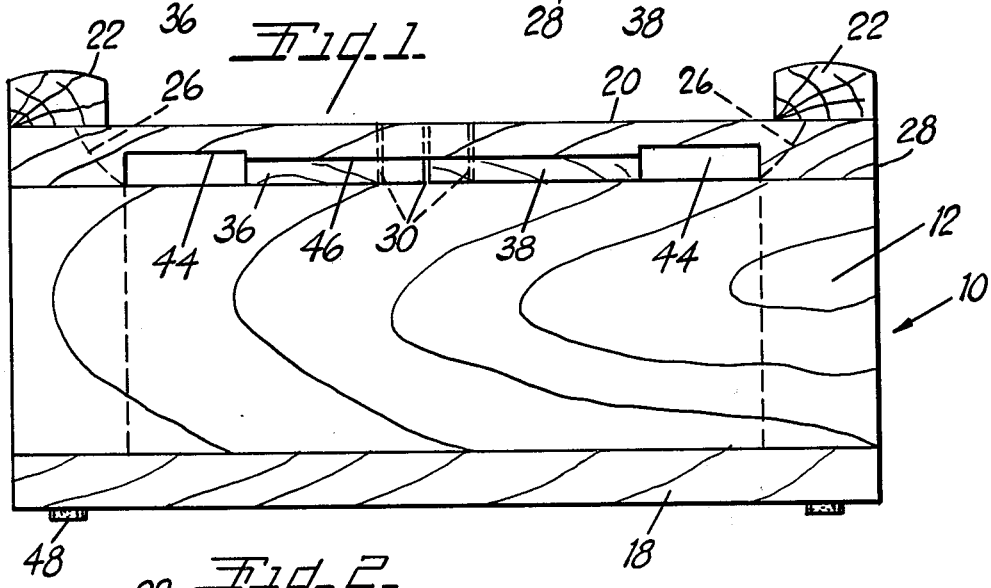
FIG. 2 is a front elevational view of the drum.
Figure 3:
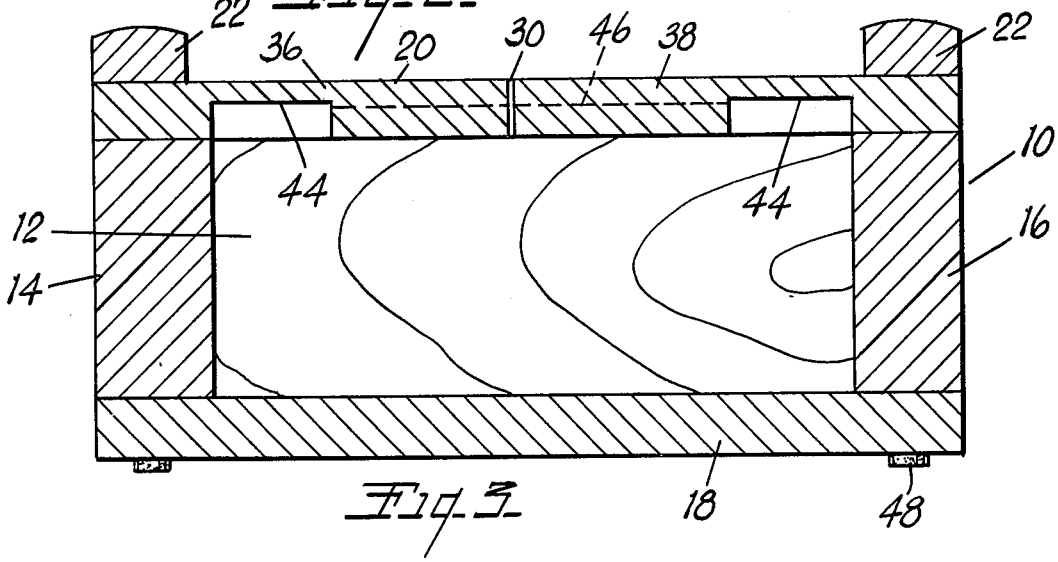
FIG. 3 is a vertical cross sectional view taken along the plane of the line 3—3 in FIG. 1.

The striking panel 20 is shaped and conformed, prior to being secured to the resonating chamber by cutting away parts of its underside and by cutting longitudinally extending slots 24 through the center portion of the panel. The slots are conveniently formed by plunge cutting with a rotary saw blade and terminate over the inner sides of the end walls 14 and 16, under the rails 22 as is indicated at 26 in FIGS. 1 and 2. This divides the panel into exterior or side strips 28 which are continuous between, and integral with, the ends of the panel and which overlie the side walls 12, and a plurality of interior strips, three being shown. The interior strips are divided by transversely extending slits or kerfs 30 into separate vibratory fingers 32, 34, 36, 38, 40 and 42, each connected integrally at its outer end to one or the other ends of the panel. It will be noted that none of the transverse slots 30 are at the same distance from an end bar or rail 22 as any other slot. The vibratory fingers accordingly increase progressively in length from 32 through 34, 36, 38, 40 and 42. Each accordingly has a different natural frequency of vibration.

The natural frequences of vibration of the several fingers 32–42 are modified and the amplitudes of vibrations are increased by cutting away the bottom panel 20 in two relatively broad slots or areas as at 44, adjacent to the inner sides of the end walls 14 and 16. The slots 44 extend through the undersides of the side strips 28 of the panel. The undersides of the side strips 28 are further cut away between the slots 44 as at 46. The side strips 28 thus form two additional vibratory panels, which in the example illustrated are equal in frequency but different than any of the fingers 32–42. Soft supporting pads or feet on the bottom of the drum are indicated at 48.

The actual tones of the several fingers 32–44 and the side strips 28 are fixed in any given form of the drum, but different tones may be predetermined by changing the width or depths of the slots, and the depths of the undercuts 46 of the side strips 28. For example, the transverse slots 44 may be tapered or angled relative to the end walls 14 and 16 and the end rails 22. It is a function of the side strips to reenforce the connections between the fixed ends of the several fingers. The width of the fingers may be varied in substitution for or in combination with the undercuts 44. It is also possible to obtain the desired spacing between the side strips 28 and the tops of the side walls 12 by reducing the height of the side walls between the end walls 14 and 16 instead of undercutting the side strips as at 46. It is believed that the side strips also transmit vibrations between the fingers to modulate and create harmonic vibrations between the fingers.

What is claimed to be new and what is desired to be protected by Letters Patent is defined in the following claims:

1. A multi-tone musical drum comprising:

wooden walls forming an open topped resonating chamber with opposed end walls and side walls of equal height, and an integral sounding panel of wood having its ends secured to the tops of said end walls, said panel being slotted to provide:

(a) spaced longitudinal slits dividing the intermediate portion of the panel into side strips and at least two interior strips, and (b) transverse slits each formed at a different distance from both of said end walls and dividing the interior strips into separate vibratory fingers overlying the resonating chamber, the underside of said panel being cut away to provide areas of reduced thickness in each of said fingers adjacent to said end walls and spaced from the free ends of the fingers, the undersides of said strips being spaced from the tops of said side walls by being cut away between said end walls.

2. A drum as defined in claim 1 in which there is further a pair of rigid end rails rigidly secured to the unslotted ends of said panel in opposed relation to the tops of said end walls.

3. A drum as defined in claim 2 in which there is further provided a bottom wall for said resonating chamber, the bottom wall, said side walls, said end walls, and said panel all being formed of flat wooden boards all adhesively secured together.

4. A drum as defined in claim 3 in which said end walls are thicker than said side walls and are shorter than the length of said end rails, the end walls having their ends lapped between the side walls with their bottoms lapped on top of the bottom wall of the resonating chamber.

5. A drum as defined in claim 1 in which there is further provided a bottom wall to said chamber, and rigid end rails secured to the top of said panel at each end in opposed relation to the tops of said end walls.

* * * * *